US005352862A

United States Patent [19]

Barr

[11] Patent Number: 5,352,862

[45] Date of Patent: Oct. 4, 1994

[54] HIGH WATTAGE SURFACE CONTACT RESISTANCE HEATER

[75] Inventor: George A. Barr, Westminister, Colo.

[73] Assignee: Five Star Manufacturing Company, Clarksdale, Miss.

[21] Appl. No.: 973,752

[22] Filed: Nov. 9, 1992

[51] Int. Cl.[5] ..... H05B 1/02; F24H 1/10

[52] U.S. Cl. ..... 219/205; 219/202; 219/484; 219/528; 219/537; 123/142.5 R

[58] Field of Search ..... 219/528, 548, 529, 537, 219/202, 205, 497, 483, 486, 484; 123/142.5 R

[56] References Cited

U.S. PATENT DOCUMENTS

| | | | |
|---|---|---|---|
| 1,758,177 | 5/1930 | Skinner . | |
| 2,619,580 | 11/1952 | Ponitiere | 219/46 |
| 3,634,655 | 1/1972 | Jordan | 219/527 |
| 3,708,650 | 1/1973 | Smillie et al. | 219/364 |
| 3,739,142 | 6/1973 | Johns | 219/212 |
| 4,279,255 | 7/1981 | Hoffman | 128/402 |
| 4,633,061 | 12/1986 | Arikawa | 219/202 |
| 4,723,065 | 2/1988 | Meyer | 219/205 |
| 4,788,417 | 11/1988 | Graflind | 219/528 |
| 4,844,029 | 7/1989 | Suzuki | 219/505 |
| 4,935,602 | 6/1990 | Bravo | 219/311 |
| 5,017,758 | 5/1991 | Kirkman | 219/205 |
| 5,105,063 | 4/1992 | Hockemier | 219/205 |

FOREIGN PATENT DOCUMENTS

| | | |
|---|---|---|
| 3334434 | 4/1985 | Fed. Rep. of Germany . |
| 0158451 | 9/1983 | Japan . |

*Primary Examiner*—Mark H. Paschall
*Attorney, Agent, or Firm*—Dowell & Dowell

[57] ABSTRACT

A pliable high wattage electrical resistance contact heater which is operable at two wattage densities and which includes a first heating element which is thermostatically controlled so as to activate at predetermined ambient and/or surface temperatures and a second overlapping heating element which is continuously activated when the heater is connected to a source of electrical power supply.

16 Claims, 3 Drawing Sheets

HIGH WATTAGE SURFACE CONTACT RESISTANCE HEATER

BACKGROUND OF THE INVENTION

Field of the Invention

This invention is generally directed to electrical resistance heaters of the type which are designed to be placed against a surface to be heated and which include heating elements which are embedded in overlapping relationship within a pliable material. More specifically, however, the present invention is directed to a surface contact electrical heater having a pair of heating elements each connected to a common source of power supply, and wherein a first heating element is energized in response to a separate thermostat connected thereto and wherein a second heating element is continuously activated whenever the heater is connected to the source of power supply. Thus, the heater operates at a lower wattage density when only the second or continuously activated heating element is energized and at a higher wattage density when the thermostat causes the first heating element to be energized.

The dual resistance heaters of the present invention are uniquely designed for use as engine oil pan heaters, however, they may also be used in many other areas including, but not limited to, transmission fluid heaters, battery heaters, livestock trough heaters, fluid pipe and conduit heaters and the like.

History of the Related Art

Electrical resistance heaters having multiple heating elements have long been known. Many such devices incorporate two or more separate resistance elements which are connected to a common source of power. In some instances, the resistance elements are designed to expand the effective heat exchange area of the heater. Examples of such heaters are disclosed in U.S. Pat. No. 4,279,255 to Hoffman and U.S. Pat. No. 4,633,061 to Arikawa. Generally, such heaters are designed to only increase the area of heat exchange and not the heat exchange density of the overall surface contact area of the heater. In the Hoffman patent, provision is made for even reducing the power density and thus the heat exchange rate of the heating elements as the size of the heat exchange area is increased by operation or energization of supplemental resistance heating elements.

Other types of electrical resistance heaters having overlapping heating elements have also been developed. Such heaters are generally designed to increase the heat exchange rate of the heater either over a portion of the surface area or along the entire surface area of the heater. U.S. Pat. No. 3,739,142 to Johns discloses an electrical heating blanket having a supplemental heating element overlapping the primary heating element so as to provide additional heat along a specific portion of the blanket, in this instance, along the area of the blanket that would be used to cover an individual's feet. The patent discloses that each of the heating elements is provided with a separate thermostatic control thus increasing the overall cost of the unit.

Other U.S. Pat. No. including 2,619,580 to Pontiere, U.S. Pat. No. 3,634,655 to Jordan and U.S. Pat. No. 4,788,417 to Graflind disclose generally flexible resistance heaters having arranged in overlapping relationship along substantially the entire area of the heater, with the exception of the patent to Graflind wherein only two overlapping elements of a multiplicity of such elements are in overlapping relationship at any point along the surface area of the heater. In each of the references either separate controls are provided for each of the heating elements or a single thermostat provided for controlling each of the heating elements. Further, in each case, the heating elements are generally designed to supply the same amount of heat output per unit of heat exchange surface area.

The aforementioned flexible resistance heaters are primarily designed for use as wraps or blankets, floor coverings and the like, and are limited in their field of use. For example, such heaters could not be used in the automotive field for use as oil pan or transmission fluid heaters. In many areas where the climate during the winter is severe with temperatures frequently being below freezing, it is necessary to provide supplemental heat sources for maintaining the oil within an internal combustion engine at a temperature which will allow the engine to be started easily. Numerous oil pan heaters have been designed and such heaters generally utilize a single heating element which operates at a given wattage for transferring heat to the oil through the oil pan by conduction. The heaters are attached or mounted to the engines in a variety of ways and, in some instances, are magnetically or adhesively secured.

U.S. Pat. No. 1,764,021 to Jackson discloses an oil heater which was designed to clamp below the oil pan and included a heating coil which heated the oil through both radiation and convection. The heater was operable at different energy settings to regulate the rate at which the oil was heated. U.S. Pat. No. 2,698,374 to Carpenter is another heating device designed to be attached to the side of an engine oil pan. The Carpenter heater incorporated a thermostat designed to monitor the temperature of the oil through the wall of the oil pan and was operable to deenergize a heating element once the oil reached a prescribed temperature.

One of the more frequent problems encountered with conventional engine oil heaters of the type which are mounted exteriorly of an oil pan is that the surface contact area between the heater and the oil pan is frequently inefficient thereby requiring wasted energy to be consumed in an effort to heat the oil to a desired temperature. Often, poor contact between the heating elements and the oil pan required that the heat exchange be accomplished more by radiation than by direct conduction.

Another problem encountered with many conventional exterior oil pan heaters is that they are designed to be regulated totally by thermostatic control so that energy is applied whenever the heater is in operation until such time as the heat within the oil pan reaches a predetermined temperature being regulated by the thermostat. In many instances it is not necessary that the oil be heated to the degree to which the thermostat has been set and thus, in some instances, either energy is wasted while, in others, potential overheating of the engine oil is possible.

In order to improve the surface contact of resistance heaters relative to the side walls of an oil pan or an engine block to thereby increase the effective conductive heat transfer, flexible reinforced silicon heaters were developed having foil heating elements chemically etched therein. Such heaters not only allowed flexibility so that the heaters could be secured following the natural contour of the oil pan or engine component, but also allowed for the heaters to be adhesively secured to the oil pan or other engine component thus decreasing the conductive heat losses. Energy to the heating elements of such devices are conventionally regulated by a thermostatic control switch. In the U.S. Pat. No. 5,017,758 to Kirkman et al., another type of flexible resistance oil pan heater is disclosed which was designed to prevent excessive temperatures from breaking down the oil within an automotive engine. This patent also utilized an etched or foil type heating element sandwiched between reinforced silicone layers, however, the heater specifically excluded the use of any thermostatic control. The heater is designed to retain the oil temperature between 170° F. and 300° F. utilizing a heating element having a uniform power density of at least 15 watts per square inch and a constant power output of about 20 to 40 watts per quart of oil within the vehicle oil pan or reservoir. Unfortunately, utilizing such a heating element requires a constant power output that it is not always necessary to maintain temperatures within the automotive engine at sufficient levels to allow for engine start-up in cold climate.

SUMMARY OF THE INVENTION

This invention is directed to a generally pliable high wattage resistance heater which incorporates overlapping heating elements which are sandwiched within silicone layers wherein each of the heating elements preferably operate at a different wattage density. The heating elements are connected to a common input so that they are simultaneously connected to a source of electrical energy, however, one of the heating elements is designed to be thermostatically controlled and only operates in response to a thermostatic detection device mounted to a body being heated. The lower density heating element is continuously activated whenever the heater is connected to a source of electrical supply so that a minimum heat transfer is being assured at all times. When conditions require that additional heat be supplied from the heater to the body to which it is attached, a thermostat will activate the other heating element thereby supplying additional heat exchange energy. Generally, the higher density heating element is embedded within the heater so that it is spaced closer to the surface contact area of the heater than is the lower density continuously activated heating element.

In one embodiment of the present invention, the heater is designed as an automotive oil pan heater including a main body portion which is adhesively secured to the outer surface of the oil pan. The thermostat for the higher density heating circuit extends outwardly from the main body of the heater and is attachable to the surface of the oil pan so as to be capable of regulating the higher density heating element in response to the temperature of the oil within the oil pan and ambient temperatures. The heater is designed to be permanently adhered to the vehicle oil pan and, in this respect, includes a separate grounding connection for attachment to the vehicle frame and a conventional electrical connector which may be plugged into any appropriate source of electrical power.

It is the primary object of the present invention to provide a pliable resistance heater which may be placed into direct contact with a body being heated so as to obtain optimum conductive heat transfer with the body and wherein the heater includes a first wattage density heating element which is thermostatically controlled and a second overlapping heating element, generally of lower wattage density than the first heating element, which is continuously activated whenever the heater is connected to a source of power supply so that the heater operates continously at a minimum wattage density, but upon activation of the first heating element, operates at a greater wattage density.

It is yet a further object of the present invention to provide a high wattage surface contact heater which may be utilized as an internal combustion engine oil pan heater wherein the amount of energy required to maintain the oil sufficiently viscous to allow for engine operation is provided using minimum energy consumption by providing overlapping heating elements within the heater wherein one of the heating elements is continuously activated whenever the heater is energized while the other heating element is only selectively operable in response to the temperature of the oil within the oil pan and ambient temperature.

DESCRIPTION OF THE PREFERRED EMBODIMENT

Figure 1:
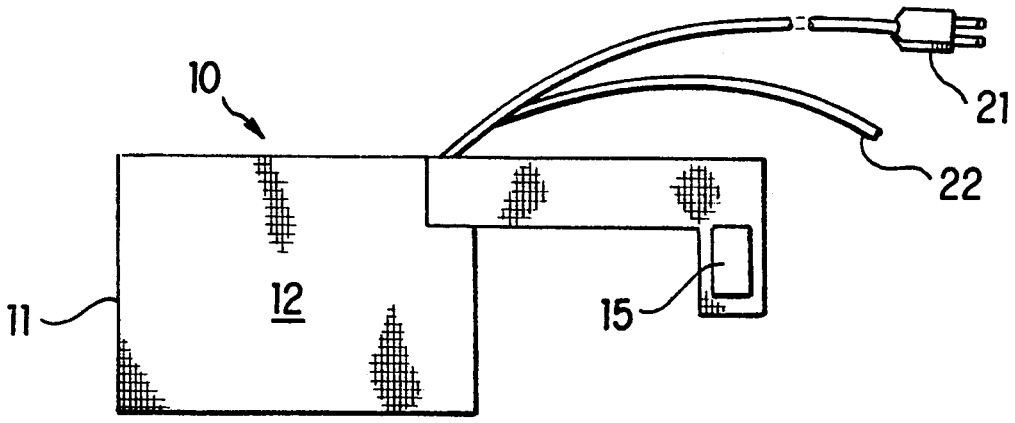
FIG. 1 is a top plan view of the high wattage surface contact heater of the present invention.

With continued reference to the drawings, the flexible high wattage resistance heater 10 of the present invention includes a main body portion 11 having an upper contact surface 12 and an outer surface 13. Extending from the main 15 is mounted so that the contact surface of the thermostat is oriented away from the main body portion of the heater. In all instances, the contact surface of the heater must be coated with a pressure/contact adhesive layer 16 which is used to secure the heater to a body to be heated such as an oil pan P of a vehicle engine. Although the present invention is primarily suitably designed for use as an exterior oil pan heater for automotive vehicles, it should be noted that the heater may be used in other environments to provide a source of constant and variable energy. Also, the adhesive layer may be separately applied at the time of installation of the heater with a silicone adhesive being preferred for most permanent installations. The thermostat 15 is adhesively secured in direct contact with the side walls of the body being heated, such as the oil pan P shown in FIG. 2.

Figure 2:
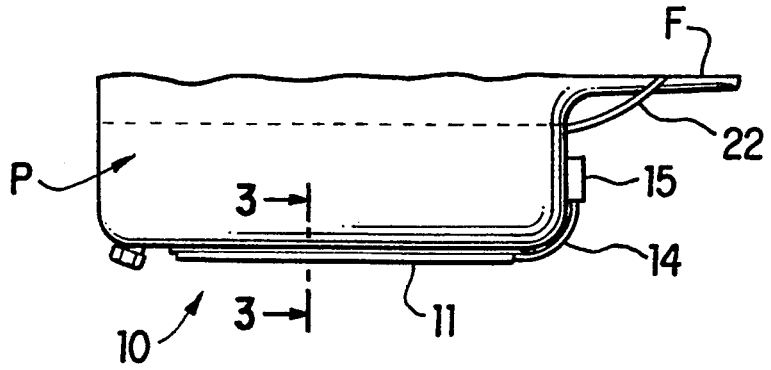
FIG. 2 is a side elevational view of the high wattage surface contact heater of FIG. 1 shown as it is adhered to the oil pan of a conventional automotive vehicle.

The heater includes a pair of internal heating elements 18 and 19 which are connected through an electrical circuit 20 to a conventional electrical connector 21 utilized to connect the heater to a suitable source of electrical power. As the heater is designed to be permanently attached to an automotive vehicle, a separate ground lead wire 22 is provided to ground the heater to the frame F of the vehicle as is illustrated in FIG. 2.

Figure 3:
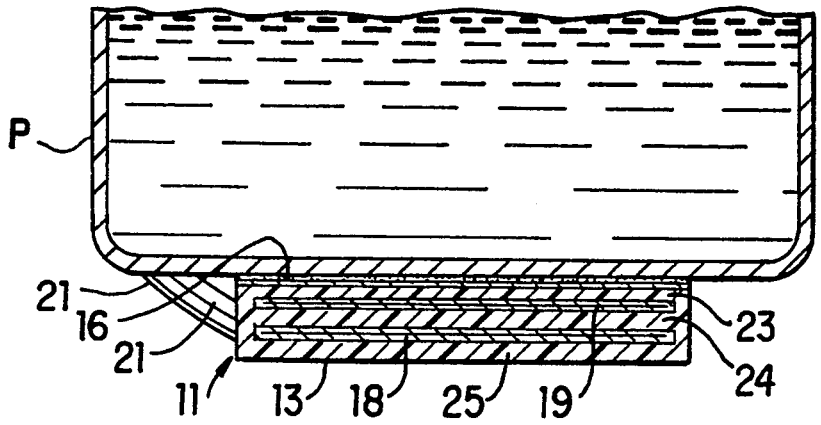
FIG. 3 is an enlarged cross-sectional view taken along lines 3—3 of FIG. 2
Figure 5:
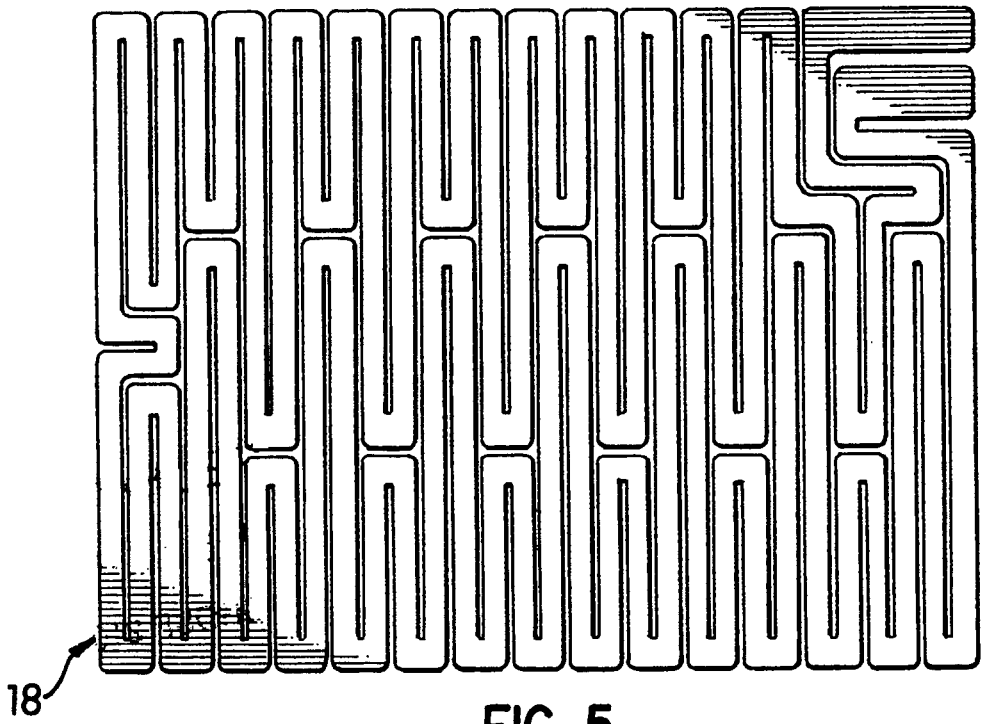
FIG. 5 is a top plan view of the lower wattage density heating element of the present invention.
Figure 6:
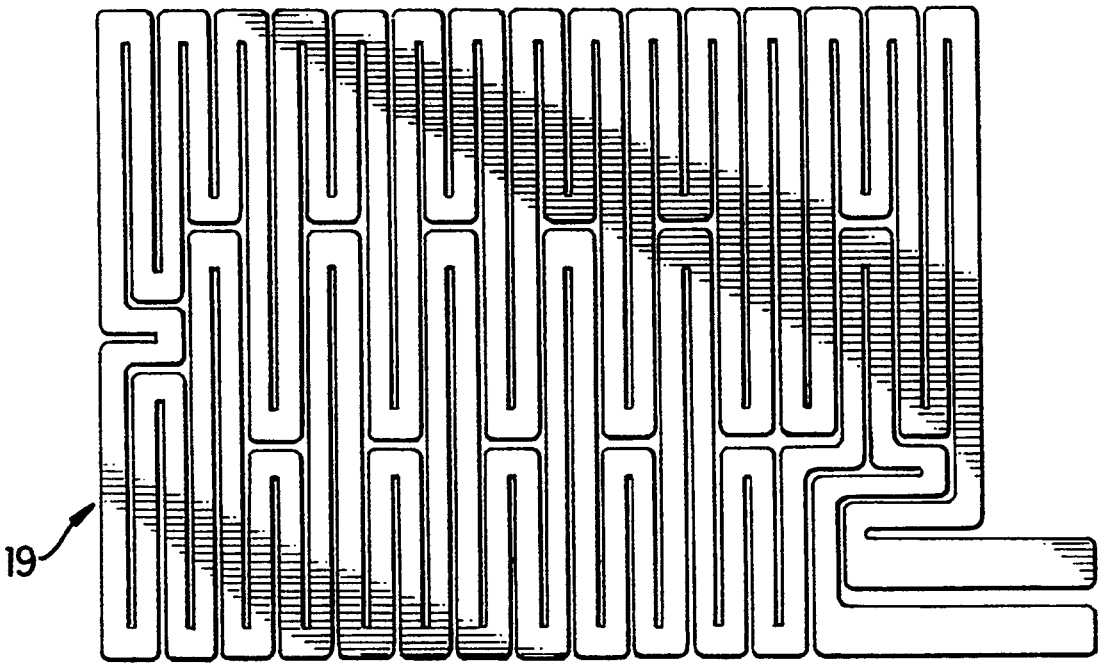
FIG. 6 is a top plan view of the higher wattage heating element of the present invention.

With specific reference to FIGS. 3, 5 and 6, the main body portion of the heater is constructed of layers of cured silicone generally designated at 23, 24 and 25. Embedded within the silicone are the heating elements 18 and 19. The heating element 18 is a lower wattage element than is the heating element 19 and both of the heating elements are constructed of an etched INCONEL or other suitable foil which is embedded within the silicone layers. Each circuit is formed of a plurality or series of closed loops as shown in FIGS. 5 and 6.

Although not shown in FIG. 3, various reinforcing materials could be embedded in the silicone layers to give added strength to the body of the heater. Typically, the heater is relatively thin and very pliable. The upper and center silicone layers 23 and 24 are generally formed of 15-mil material whereas the lower or outer layer 25 is generally formed of a thicker cured silicone material such as a 28-mil material. The thickness of the heating elements is approximately 1-mil. It should be noted that other types of heating elements could be utilized in keeping with the teachings of the present invention and that other materials could be utilized to form the main body or housing for the heating elements.

Figure 4:
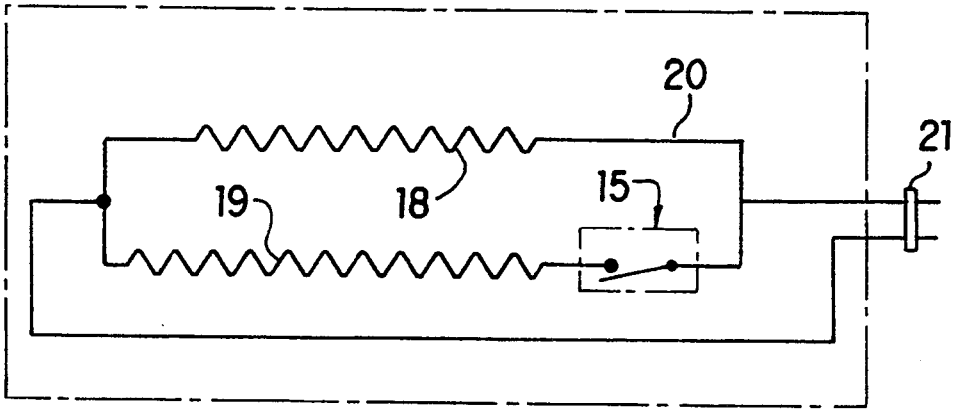
FIG. 4 is an electrical circuit diagram of the heating elements of the present invention.

With particular reference to FIG. 4, the electrical circuit diagram shows that the lower wattage heating element 18 is connected directly in series with the source of power supply when the electrical plug 21 is connected to such a source. However, the higher wattage density heating element 19 is connected through the thermostat 15 to the source of power supply. In view of the foregoing, whenever the electrical connector 21 is connected to a source of electrical energy, power will be continuously supplied to the lower wattage heating element 18. In this manner, heat is continuously supplied through the heating element 18 by conduction to the oil pan or other body being heated. When the thermostat senses that the temperature of the body or, in the embodiment shown at FIG. 3, that the temperature of the oil within the oil pan is below a predetermined temperature, the higher wattage heating element 19 will be activated and will remain activated until the temperature reaches the limit regulated by the thermostat.

In the preferred embodiment, the lower wattage heating element is preferably mounted more remotely from the body being heated as is shown in FIG. 3. By way of one specific example, a 600 watt heater may incorporate heating elements 18 and 19 wherein one-third of the wattage will be supplied by element 18 and two-thirds by element 19. The main body of the heater is approximately 5×7 inches. Thus, element 18 has a rating of approximately 200 watts and a wattage density of 5.71 watts per square inch. The higher wattage heating element 19 has a rating of approximately 400 watts and contributes approximately 11.43 watts per square inch of power. When only the lower wattage element 18 is in operation, the heater develops approximately 200 watts of power, whereas when both heating elements are operated, the heater develops 600 watts of power with an overall wattage density of approximately 17.14 watts per square inch.

Although the wattages can be varied between the two heating elements, it is generally desired that the wattage density not exceed approximately 18 to 20 watts per square inch so as to insure that there is no break down of the oil within the oil pan of an automotive vehicle. In those instances where the heater is to be utilized to heat objects other than oil reservoirs, the requirement for regulating the maximum wattage density may not be as critical. Further, the exact wattage of each of the heating elements could be varied and, in some instances, it may be desired that they be the same, and in other instances that the difference between the low and high wattage heating elements be greater than that disclosed in the example set forth.

Examples of heaters having different wattage heating elements are a 300 watt heater and a 1200 watt heater. A 300 watt heater having a dimension of 4.5×4.5 inches would have a 100 watt heating element 18 and a 200 watt heating element 19 and would have a maximum power density of approximately 14.82 watts per square inch. A 1200 watt heater having a dimension of 6.5×11.5 inches would have a heating element 18 of approximately 400 watts and a heating element 19 of approximately 800 watts and develop a maximum power density of approximately 16.05 watts per square inch.

In the use of the heater of the present invention to heat the oil within the oil pan of a vehicle such as an automobile, the heater 10 is secured by an adhesive layer 16 to an exterior portion of the oil pan so as to be in substantially continuous contact and heat exchange relationship therewith. When an adhesive is applied to the heater for attachment, the adhesive layer should be carefully rolled out and compressed to insure the exclusion of all air bubbles and to reduce the adhesive thickness to approximately 1/32 inch. This will allow heat exchange to be accomplished conductively thereby increasing the effectiveness of the heat exchange. After the main body of the heater has been secured, the extension element is positioned around a portion of the oil pan and the thermostat 15 adhesively secured in direct heat exchange relationship to a portion of the pan remote from the heater as is shown in FIG. 2. It is preferred that the thermostat be located at a point remote from the body of the heater so that the thermostat is sensing the temperature of oil within the oil pan at point spaced from the area where heat is being exchanged. Also, the thermostat should be placed approximately at the midpoint of the oil level so that the temperature being sensed is an average temperature for the oil in the oil pan.

Thereafter, the ground lead wire 22 is connected to an appropriate portion of the vehicle frame and the electrical connector 21 connected to an extension cord extending from a source of electrical energy such as a conventional AC outlet. As soon as the heater has been energized, the low wattage heating element 18 will be activated thereby providing a constant source of lower density energy. Should the thermostat 15 determine that the temperature of the body being heated, such as the oil within the oil pan, is below a predetermined temperature, the higher wattage heating element 19 will be activated thereby increasing the overall heat exchange rate developed by the heater. The heating element 19 will remain activated until the temperature of the oil reaches a predetermined degree at which time the thermostat 15 will open thereby preventing further activation of heating element 19.

I claim:

1. A dual operational electrical resistance heater comprising, a pliable body having an inner contact surface and an outer surface, a first heating element disposed within said body and having a first wattage density per unit area, a second heating element disposed within said body, said first and second heating element being in overlapping relationship to one another, said second heating element having a second wattage density per unit area, said first wattage density being greater than said second wattage density, connector means for connecting said first and second heating elements to a source of electrical power supply, said second heating element being non-thermostatically controlled so as to be continuously energized when said connector means is connected to a source of electrical power supply, a thermostat means mounted between said connector means and said first heating element for regulating the power supply to said first heating element, whereby when said connector means is connected to the source of electrical power supply said second heating element is activated to provide a continuous source of heat and said first heating element is activated in response to said thermostat.

2. The electrical resistance heater of claim 1 in which said first heating element is disposed between said second heating element and said inner contact surface of the heater.

3. The electrical resistance heater of claim 1 including an adhesive layer provided along said inner contact surface of said body for securing said heater to an object.

4. The electrical resistance heater of claim 1 in which said second wattage density is generally not greater than approximately one-third of the total wattage density of said first and second wattage densities.

5. The electrical resistance heater of claim 1 including a flexible electrically insulated material layer disposed between said first and second heating elements.

6. The electrical resistance heater of claim 5 in which each of said first and second heating elements are etched foil circuits, and said body is formed of an electrically insulated material.

7. The electrical resistance heater of claim 5 including an extension portion extending outwardly from said body, said thermostat being mounted on said extension portion remote from said body.

8. The electrical resistance heater of claim 1 including an extension portion extending outwardly from said body, said thermostat being mounted on said extension portion remote from said body.

9. A dual operational electrical resistance heater for use in heating the oil in an oil pan of a vehicle comprising, a pliable body having an inner contact surface and outer surface, a first heating element disposed within said body and having a first wattage density per unit area, a second heating element disposed within said body in overlapping relationship to said first heating element, said second heating element having a second wattage density per unit area which is less than said first wattage density, connector means for connecting said first and second heating elements to a source of electrical power supply, said second heating element being non-thermostatically controlled so as to be continuously energized when said connector means is connected to a source of power supply, thermostat means mounted between said connector means and said first heating element for regulating power to said first heating element whereby when said connector means is connected to the source of electrical power supply said second heating element is activated to provide a continuous source of heat to the oil pan and said first heating element is activated in response to said thermostat means to increase the heat supply to the oil in the oil pan.

10. The electrical resistance heater of claim 9 in which said first heating element is mounted between said second heating element and the inner contact surface of the heater.

11. The electrical resistance heater of claim 10 including adhesive means for mounting said body to the oil pan.

12. The electrical resistance heater of claim 11 including means for securing said thermostat means to the oil pan.

13. The electrical resistance heater of claim 10 in which said pliable body includes a main body portion and an outwardly extending element mounted thereto, said thermostat means being mounted remotely from said main body portion along said outwardly extending element.

14. The electrical resistance heater of claim 9 in which said first and second heating means have a combined wattage density not exceeding approximately twenty watts per square inch.

15. The electrical resistance heater of claim 14 in which said second wattage density is not greater than approximately one-third of the combination of said first and said second wattage densities.

16. The electrical resistance heater of claim 10 in which said second wattage density is not greater than approximately one-third of the combination of said first and said second wattage densities.

* * * * *